United States Patent [19]

Miyazaki

[11] 4,123,895

[45] Nov. 7, 1978

[54] GEAR TRAIN OF QUARTZ-CRYSTAL TIMEPIECE HAVING ANALOGUE DISPLAY

[75] Inventor: Joichi Miyazaki, Tokyo, Japan

[73] Assignee: Kabushiki Kaisha Daini Seikosha, Japan

[21] Appl. No.: 755,218

[22] Filed: Jan. 3, 1977

[30] Foreign Application Priority Data

Jun. 18, 1976 [JP] Japan ..... 51-71790

[51] Int. Cl.[2] ..... G04B 19/02; G04C 3/00

[52] U.S. Cl. ..... 58/23 BA; 58/23 D; 58/59; 58/125 R

[58] Field of Search ..... 58/23 BA, 23 D, 59, 58/125 R, 125 B, 126 R, 126 A, 126 D

[56] References Cited

U.S. PATENT DOCUMENTS 3,792,578 2/1974 Hetzel ..... 58/23 D

*Primary Examiner*—Stanley J. Witkowski

*Attorney, Agent, or Firm*—Robert E. Burns; Emmanuel J. Lobato; Bruce L. Adams

[57] ABSTRACT

In a timepiece, a seconds gear wheel mounted for rotation on a plate, and a battery and a gear train mounted on opposite sides of the seconds gear wheel. The gear train engages the seconds gear wheel and a transducer for rotating the seconds gear wheel. The seconds gear wheel has a radius smaller than a difference between a radius of the plate and a diameter of the battery. The resulting structure is very compact.

2 Claims, 3 Drawing Figures

GEAR TRAIN OF QUARTZ-CRYSTAL TIMEPIECE HAVING ANALOGUE DISPLAY

BACKGROUND OF THE INVENTION

This invention relates to a gear train of an electronic timepiece in which the timepiece analogue display is driven every 1 second, are relates further to a gear train in a small-sized electronic timepiece having analogue display wherein the layout of said timepiece is such that a timepiece battery does not protrude out of the periphery of a timepiece plate.

In the conventional analogue electronic timepiece of this type, the gear train has been arranged as follows, a second wheel is put in the center of the timepiece and a battery is positioned at the side of said second wheel to get maximum space for battery. Said second wheel has a gear, whose number of teeth is 60. A jumper engaging the second wheel resiliently indexes said wheel. Under the present state of precision fabrication, it is very difficult to machine accurately a gear wheel, the profile of which has the shape of the main gear train for a timepiece and which has the outer diameter not greater than 3.7 millimeters and 60 teeth and a module not greater than 0.06 millimeters. Therefore the available diameter of the gear wheel is somewhat large, so the space to receive the battery is positioned distant from the center of the timepiece. The outer diameter of a regular battery for a man's watch is about 11.6 millimeter. When the regular battery is arranged adjacent to the second wheel, the radius of the plate which surrounds the battery completely comes to not less than 13.45 millimeters. This value does not contain the clearance between the battery and the second wheel or other member. When said clearance is considered, the radius of the plate or movement comes to more than 14 millimeters. Assuming that the outer diameter of the plate is 26 millimeters, the arranged battery will protrude about 1 millimeter outof the plate. Namely the maximum radius of the movement is given by the sum of the radius of the second wheel, the diameter of the battery and said clearance. Therefore if it is wanted to design the plate rather small, the battery will protrude out of the plate. In this case the watch case needs a recess receiving said battery so the cost of manufacturing is high. And if it is wanted to arrange the battery within the plate, the diameter of the plate must be large enough to include said maximum radius which is given by the radius of the second wheel, the diameter of the battery and the clearance between the battery and the second wheel or other member. In this case the size of the watch is large so a case having a good appearance has not been available.

SUMMARY OF THE INVENTION

The object of this invention is to eliminate these disadvantages that comes from a conventional gear train and to present an electronic timepiece having analogue display, the movement thereof being able to be made small.

DESCRIPTION OF THE PREFERRED EMBODIMENTS

Figure 1:
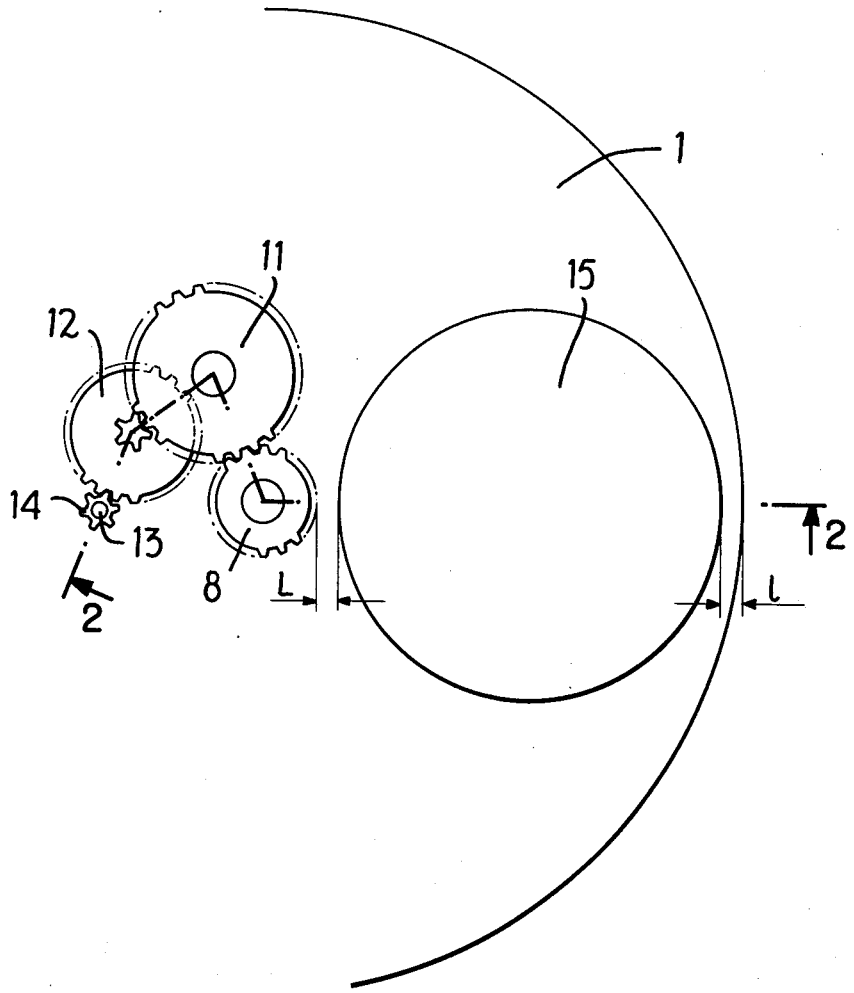
FIG. 1 shows a plane view of an embodiment according to this invention.
Figure 3:
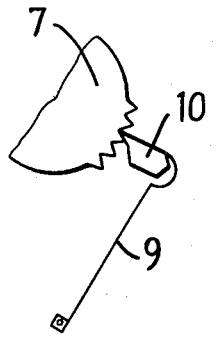
FIG. 3 shows a plane view of the indexing wheel in the state of being indexed.
Figure 2:
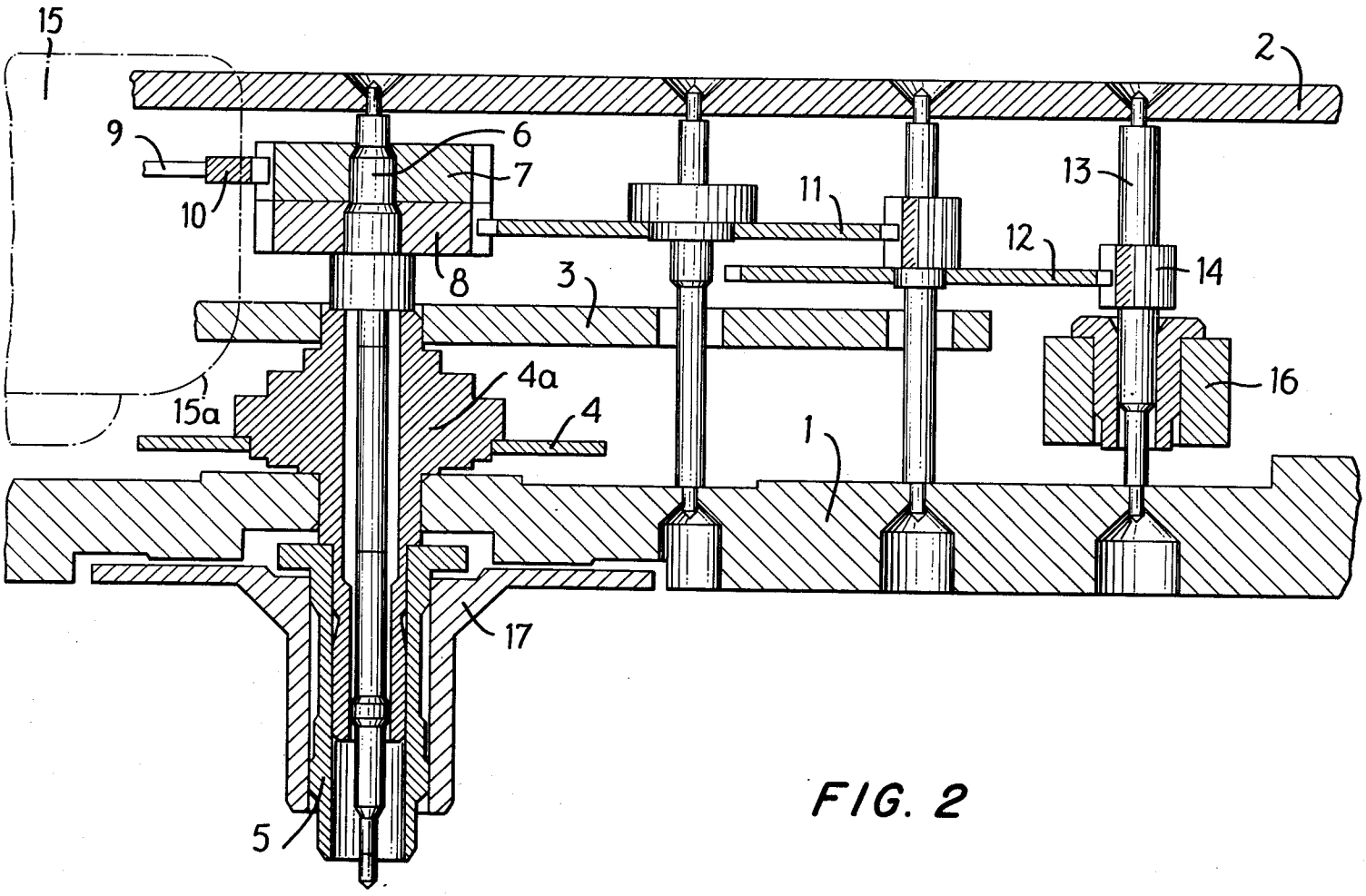
FIG. 2 is a sectional view along the line 2—2 in the FIG. 1.

FIG. 1 shows a plane view of a main gear train of a watch according to this invention, FIG. 2 is a sectional view along the line 2—2 in FIG. 1, and FIG. 3 is a plane view of an indexing wheel in the state of being indexed. In these figures, 1 is a plate, 2 shows a bridge which is disposed in parallel with the plate, and 3 represents a center wheel bridge which is interpassed between the plate 1 and the bridge 2. The axle 4*a* of a center wheel 4 is supported between the plate 1 and the center wheel bridge 3 rotatably at the center of the plate 1. The axle 4*a* is formed in a pipe shape, and one end of the axle protrudes through the plate 1 towards a dial and carries a cannon pinion 5. On the protrudent portion of the axle 4*a*, a cannon pinion which carries a minutes hand (not shown) is attached frictionally. The numeral 6 is a second axle which penetrates the pipe of the center wheel and is rotatably supported between the bridge and a part of the wall of said pipe. A second gear 8 and an indexing wheel 7 is secured to the portion of the axle extending through the space between the bridge 2 and the center wheel bridge 3. Said indexing wheel 7 has 60 teeth for indexing as illustrated in FIG. 3, wherein said teeth are engaged with a indexing stone 10 resiliently and which is secured at a end of indexing lever 9. Since said indexing wheel 7 does not transmit power, the profile of teeth may be constructed in a ratchet form which is easy to machine and does not need high accuracy in manufacturing, so that the indexing wheel can have 60 teeth in the same diameter as the second gear 8.

Said second gear 8 has 30 teeth in it, and meshes with a idle gear 11 (fifth gear wheel). This idle gear 11 engages with a rotor pinion 14 which is fixed on the rotor shaft 13 of an electro-mechanical transducer, which includes rotor 16, through a reduction gear wheel 12 (sixth gear wheel). Namely the rotary motion of the rotor pinion 14 is transmitted to the second wheel 8, being reduced in rotation speed to 1/60 revolution per minute, and then the second hand is driven one step per second. The numeral 15 shows a battery disposed beside the second wheel 8. The battery 15 is positioned opposite the place of the reduction gear 12. A part of the center wheel 4, the diameter of which is larger than that of the second wheel is arranged under the shoulder 15*a* of the battery. In the above described construction, when 30 is chosen for the number of teeth of the second wheel, the module of which is the same as a conventional one, the diameter of the second wheel according this invention is one half the diameter of the conventional wheel's. Though the diameter of the second wheel is small, it is possible to transmit power from the motor to the main gear train by engaging the idle gear 11 between the rotor pinion 14 and the second wheel 8.

In the embodiment according to this invention, choosing 2.0 millimeters for the outer diameter of the second wheel, 1.8 millimeters for the pitch diameter (namely 0.06 millimeters for the module), 11.6 millimeters for the diameter of the battery, 25.6 millimeters for the diameter of the plate, 0.01 millimeters for the clearance L between the second wheel 8 and the battery 15, results in 0.1 millimeter for the distance *l* between the battery and the periphery of the plate (clearance between the battery and the periphery of the plate), and a small sized movement for a time-piece including a battery.

Further, in the drawings, numeral 16 is the rotor, numeral 17 shows a hour wheel, but their structure need not be described in detail since they comprise fundamentally the same mechanisms as that of a conventional time-piece.

Moreover, in the above description, this invention was explained in an embodiment of the gear train having a center second hand, however this invention can be applied to a gear train without a second hand.

Still more, the gear train according to this invention can be constructed without indexing wheel and the indexing lever, when the analogue quartz crystal timepiece is not highly accurately rotationally position the second wheel.

As stated above, according to this invention, the main gear train is constructed such as the number of teeth of the second wheel is not more than 60, and the diameter thereof is made small, so the regular sized battery can be arranged within the periphery of the plate or movement of a watch very easily, accordingly, miniaturization of the quartz crystal watch is high. Further the watch case does not need a recess for receiving a protruding battery, so fabrication of the case is improved remarkably and it is expected that the cost of manufacturing the case is decreased.

Still, as the battery can be arranged within the periphery of the watch movement, a cover for exchanging battery can be arranged conveniently, accordingly the watch case design can be refined. This invention has the abovementioned various advantages.

What is claimed is :

1. In a timepiece: an electro-mechanical transducer; a seconds gear wheel mounted for rotation and rotated to indicate passage of time in units of seconds; a battery for powering said electro-mechanical transducer; a plate having said seconds gear wheel, said battery and said electro-mechanical transducer disposed thereon; mounting means for rotatably mounting said seconds gear wheel on said plate; and a gear train engaging said seconds gear wheel and said electro-mechanical transducer for rotating said seconds gear wheel to indicate passage of time in units of seconds upon operation of said electro-mechanical transducer, said gear train comprising at least two gear wheels each engaging a respective one of said electro-mechanical transducer and said seconds gear wheel, and wherein at least one of said two gear wheels is an idle gear; and wherein said seconds gear wheel has a radius smaller than a difference between a radius of said plate and a diameter of said battery, and said plate has a diameter less than 26 millimeters.

2. In a timepiece according to claim 1, wherein said gear train and said battery are disposed on opposite sides of said seconds gear wheel.

* * * * *